US005726406A

United States Patent [19]

Bolongeat-Mobleu et al.

[11] Patent Number: 5,726,406

[45] Date of Patent: Mar. 10, 1998

[54] ELECTRICAL VACUUM SWITCH

[75] Inventors: Roger Bolongeat-Mobleu, Echirolles; Hans Schellekens, Meylan, both of France

[73] Assignee: Schneider Electric SA, France

[21] Appl. No.: 653,242

[22] Filed: May 24, 1996

[51] Int. Cl.[6] ..... H01H 33/66

[52] U.S. Cl. ..... 218/123; 218/127; 218/129

[58] Field of Search ..... 218/123–138

[56] References Cited

U.S. PATENT DOCUMENTS

| | | | |
|---|---|---|---|
| 3,809,836 | 5/1974 | Crouch | 218/128 |
| 3,946,179 | 3/1976 | Murano et al. | 218/129 |
| 4,260,864 | 4/1981 | Wayland et al. | 218/129 |
| 4,336,430 | 6/1982 | Kurosawa et al. | 218/129 |
| 4,504,711 | 3/1985 | Zuckler | 218/123 |
| 4,516,004 | 5/1985 | Bany et al. | 218/123 |
| 4,675,483 | 6/1987 | Gebel et al. | 218/129 |
| 4,704,506 | 11/1987 | Kurosawa et al. | 218/128 |
| 4,839,481 | 6/1989 | Nash et al. | 218/128 |
| 5,293,506 | 3/1994 | Yorita | 218/128 |

FOREIGN PATENT DOCUMENTS

| | | | |
|---|---|---|---|
| 0088040 | 9/1983 | European Pat. Off. | H01H 33/66 |
| 0525354 | 2/1993 | European Pat. Off. | H01H 33/66 |
| 715324 | 6/1996 | European Pat. Off. | H01H 33/66 |
| 2211737 | 7/1974 | France | H01H 33/66 |
| 2038098 | 7/1980 | United Kingdom | H01H 33/66 |
| 2038557 | 7/1980 | United Kingdom | H01H 33/66 |

*Primary Examiner*—J. R. Scott
*Attorney, Agent, or Firm*—Parkhurst & Wendel

[57] ABSTRACT

An elongated vacuum cartridge having a cylindrical enclosure blanked off by two end-plates and housing a stationary arcing contact securedly united to one of the end-plates and a movable arcing contact mounted axially and slidingly inside the cartridge thereby providing a closed position and a separated position of the arcing contacts. An axial magnetic field in the arc formation zone is provided by a horizontal component of arcing current having an inclined trajectory with resect to the plane of the contact surfaces of the arcing contacts, the inclined trajectory being provided by angularly offset and alternating conductive and non-conductive sectors on the ends of each of the arcing contacts.

11 Claims, 4 Drawing Sheets

ELECTRICAL VACUUM SWITCH

BACKGROUND OF THE INVENTION

The present invention relates to a switch designed to open an electrical circuit and comprises an elongated vacuum cartridge, said cartridge comprising a cylindrical enclosure blanked off by two end-plates and housing two arcing contacts, one, stationary, of which contacts is securedly united to one of the afore-mentioned end-plates whereas the other, movable, contact is mounted axially and slidingly inside the cartridge between a closed position and a separated position of the contacts resulting in formation of an arcing current, and means designed to produce an axial magnetic field in the am formation zone.

Several means are known for producing an axial magnetic field in the arc formation zone, this magnetic field enabling the breaking capacity of the cartridge to be increased by generating diffusion of the arc and preventing any concentration of energy at a particular point.

French Patent FR 2,677,487 filed by the applicants describes an electrical switch of the kind referred to, wherein the axial magnetic field is generated by the current flowing in a coil securedly united to the end-plate of the cartridge and disposed coaxially to this cartridge and facing the gap separating the arcing contacts.

In French Patent FR 2,682,808 also filed by the applicants, the ring-shaped coil is placed outside the cartridge in an annular housing formed in the end-plate of the cartridge.

European Patent Application EP 0,597,434 is also known, describing vacuum switches wherein the arcing contacts are constituted so as to form a winding or one or more portions of a winding, enabling the axial magnetic field for arc diffusion to be created when circuit breaking takes place.

It is also known to place a winding or a magnetic circuit behind each contact.

All these embodiments therefore require the use of additional elements, such as a coil or a magnetic circuit, or the achievement of contacts of complex form, which results in a high manufacturing cost of the switches in which they are designed to be used.

SUMMARY OF THE INVENTION

The present invention overcomes the aforementioned drawbacks and proposes an electrical switch, notably a vacuum switch, of particularly simple design.

For this purpose, the object of the present invention is to provide an electrical switch, comprising means for imposing on the arcing current an inclined trajectory with respect to the plane of the contact surfaces of the arcing contacts, the current thus directed generating the afore-mentioned axial magnetic field.

According to a particular embodiment of the invention, the afore-mentioned means are borne by the arcing contacts.

According to a particular feature, each arcing contact comprises a conducting rod comprising at one of its ends a contact part on which an electrode is fixed, the afore-mentioned contact part and electrode being electrically connected by at least one conducting portion securedly united to the contact part or the electrode, said portions being arranged in such a way that the conducting portions of the stationary arcing contact are not facing those belonging to the movable arcing contact.

According to another particular feature, the contact parts are in the form of a disk and the electrodes in the form of a crown or of a disk.

According to another feature, the conducting portions are sectors of a crown, the sectors associated to the stationary arcing contact being angularly offset with respect to those associated with the movable arcing contact.

Advantageously, the afore-mentioned conducting portions are integral parts of the contact parts and are formed at the periphery of said parts.

According to a particular embodiment, each arcing contact comprises a crown sector.

According to an alternative embodiment, each arcing contact comprises two diametrically opposite crown sectors.

According to another alternative embodiment, each arcing contact comprises three equidistant crown sectors.

According to another feature, the end of each contact part is in the form of a crown, said crown being formed by the afore-mentioned conducting crown sectors and by non-conducting crown sectors.

Advantageously, the afore-mentioned non-conducting crown sectors are made of an insulating or refractory material.

BRIEF DESCRIPTION OF THE DRAWINGS

Other advantages and features of the invention will become more clearly apparent from the following description referring to the accompanying drawings given as examples only and in which.

DETAILED DESCRIPTION OF THE PREFERRED EMBODIMENT

Figure 1:
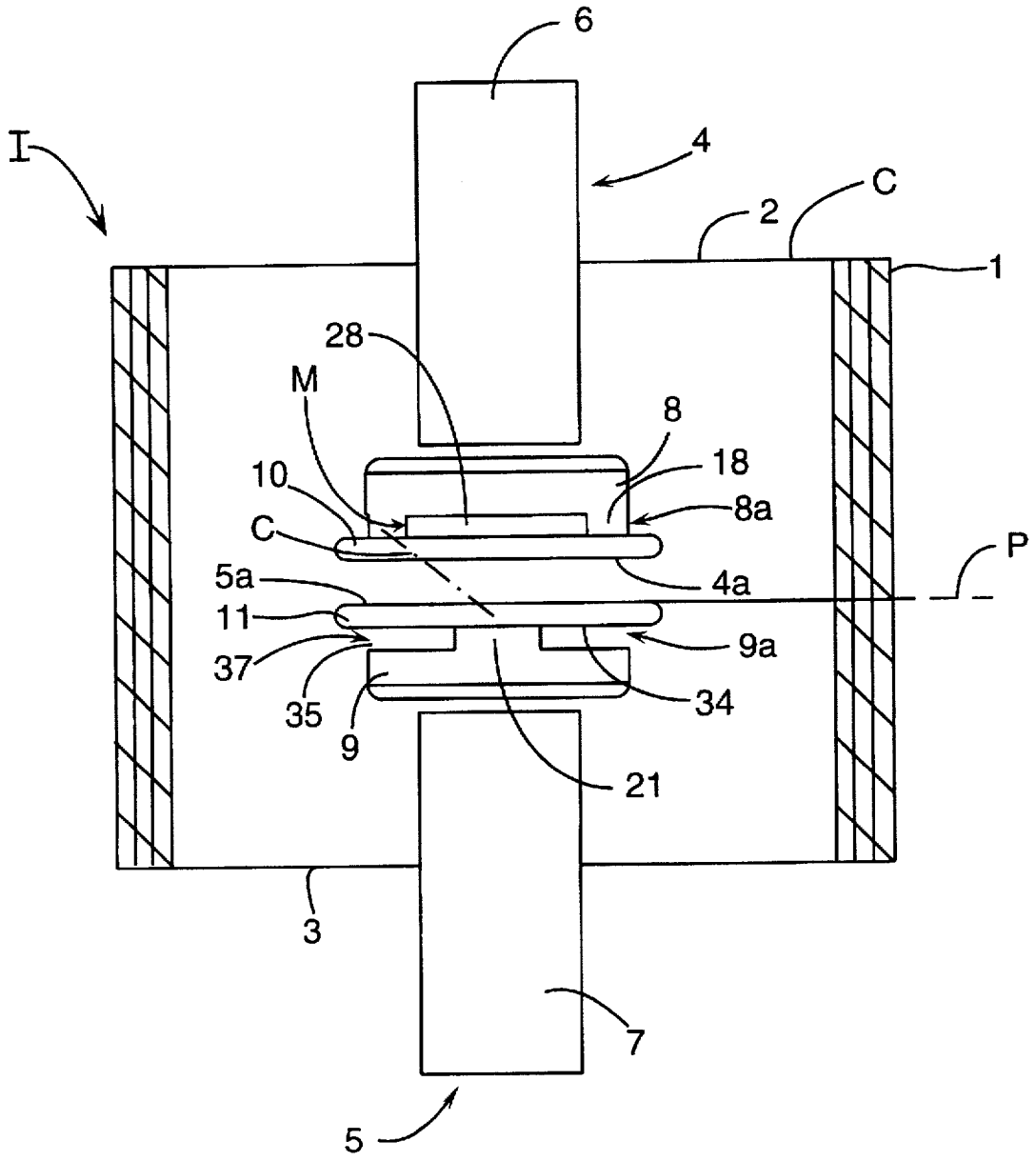
FIG. 1 illustrates, in a cross-sectional view, a vacuum switch according to a particular embodiment of the invention.

In FIG. 1, a switch I can be seen with a vacuum cartridge C mainly comprising a cylindrical-shaped insulating enclosure 1 closed by two metal end-plates 2, 3 and housing two arcing contacts 4, 5 respectively stationary and movable extending coaxially inside said enclosure 1. The stationary contact 4, is securedly united to end-plate 2 of the enclosure 1, whereas movable contact is slidingly mounted through end-plate 3. Movable contact 5 is moved in translation by an operating mechanism, not represented, between a closed position allowing the current to flow between the contacts 4, 5 and a separated position (represented in FIG. 1) in which an arcing current "c" occurs between the contacts 4, 5 prior to circuit breaking being achieved.

The two arcing contacts 4, 5 have the same structure and are each formed by a conducting rod 6, 7 comprising at one of its ends a contact part 8, 9 in the form of a and disk being an integral part of said rod 6, 7. On the free end 8*a*, 9*a* of this disk-shaped part 8, 9 there is fixed a conducting electrode 10, 11 in the form of a crown whose diameter is slightly greater than that of the disk-shaped part 8, 9.

According to a particular embodiment of the invention, the means used to produce an axial magnetic field in the arc formation zone comprise means M borne by the arcing contacts 4, 5, to impose on the arcing current an inclined trajectory with respect to the plane P of the contact surfaces 4*a*, 5*a* of the arcing contacts 4, 5, shown in FIG. 1.

Figure 2:
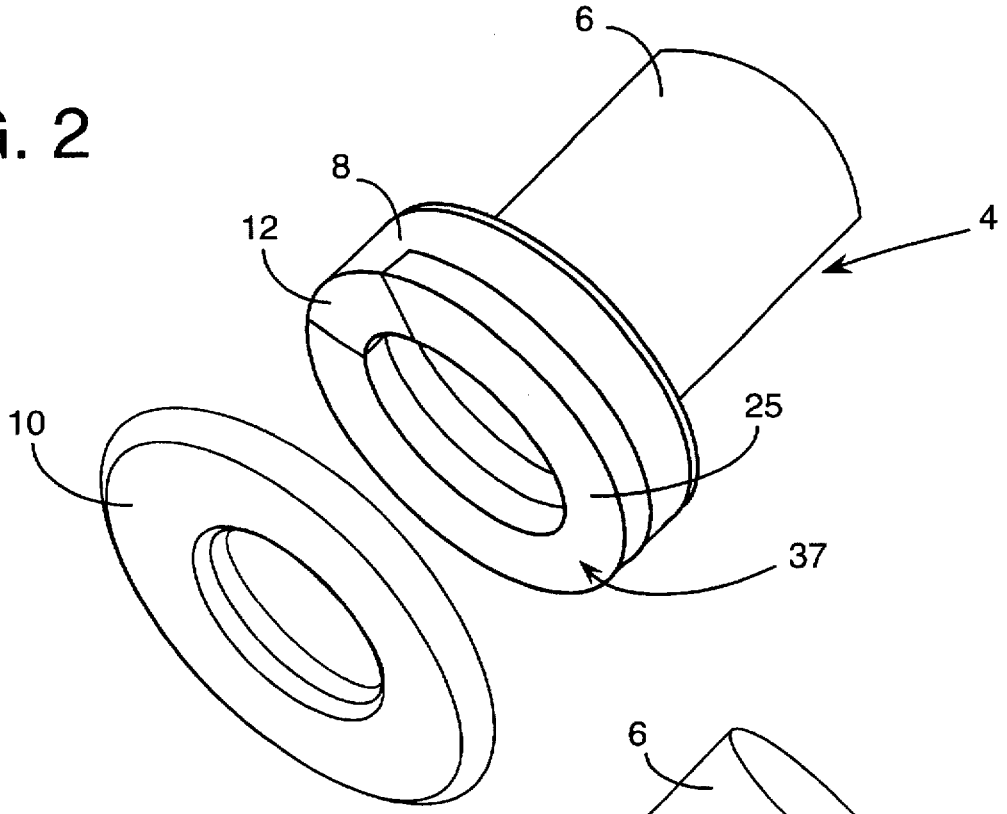
FIGS. 2, 4 and 6 illustrate respectively, in exploded views, one of the arcing contacts of the switch, according to three different embodiments of the invention.
Figure 3:
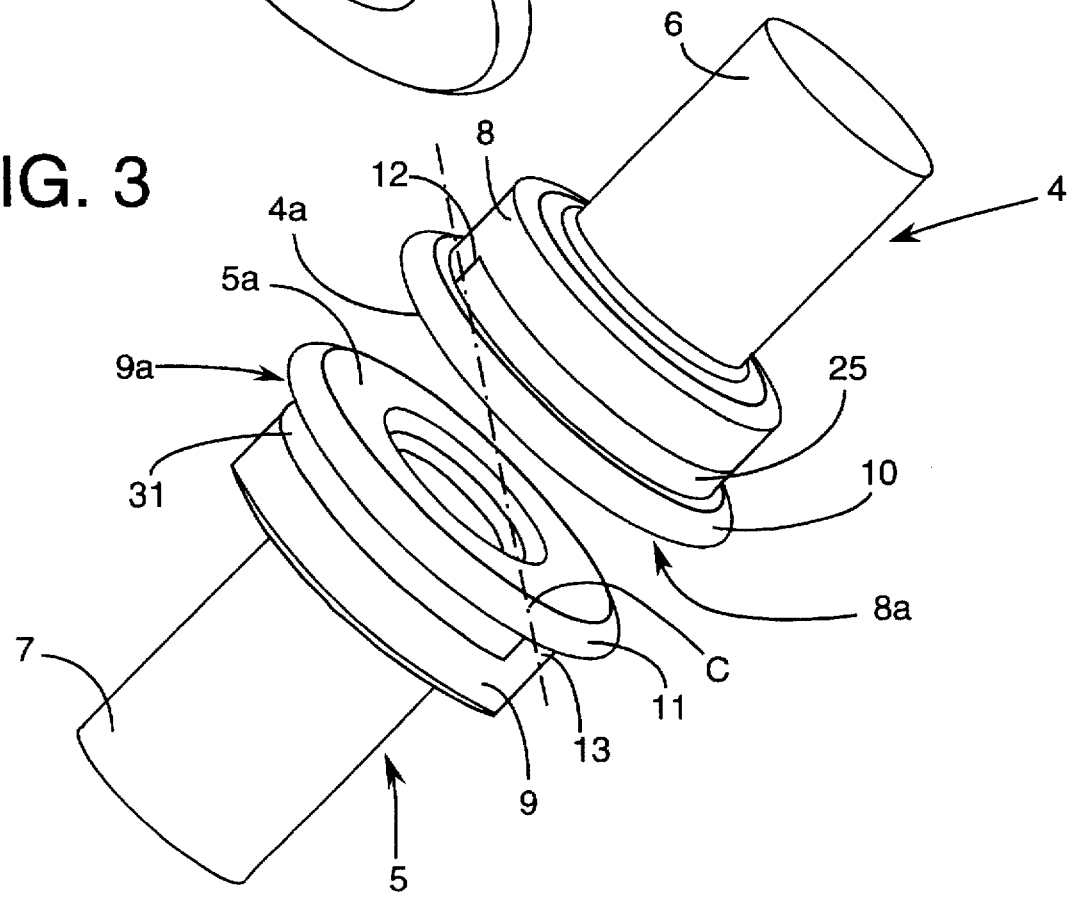
FIGS. 3, 5 and 7 illustrate respectively, in perspective views, the two arcing contacts according to the afore-mentioned three embodiments of the invention.
Figure 4:
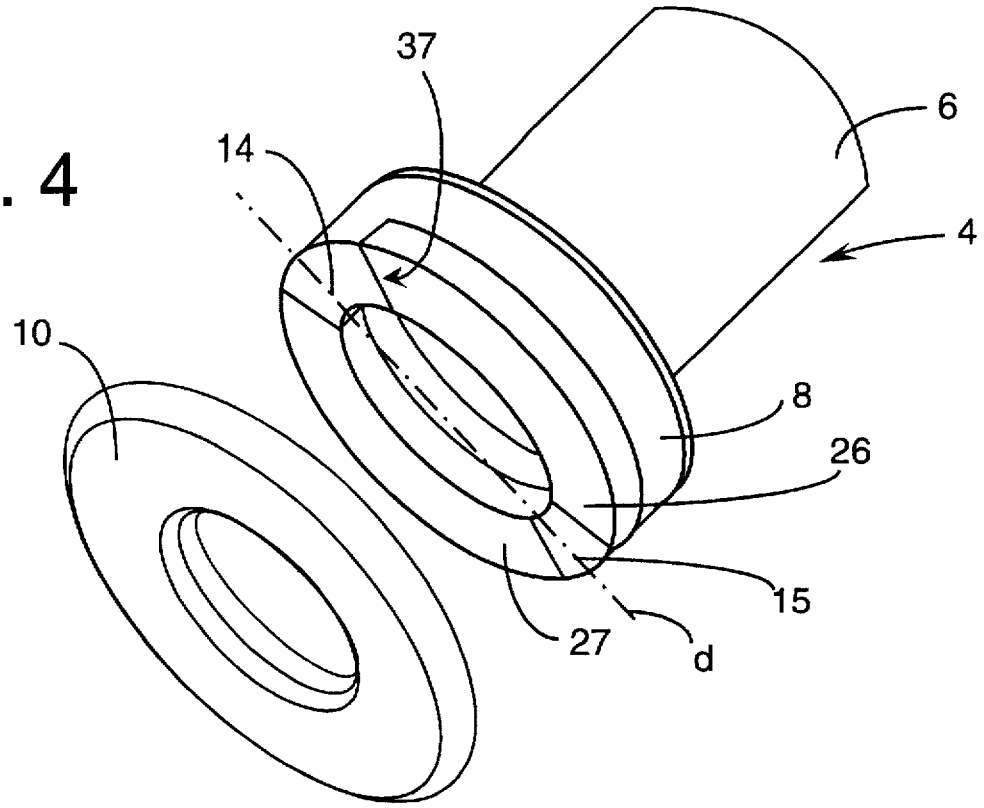
Figure 5:
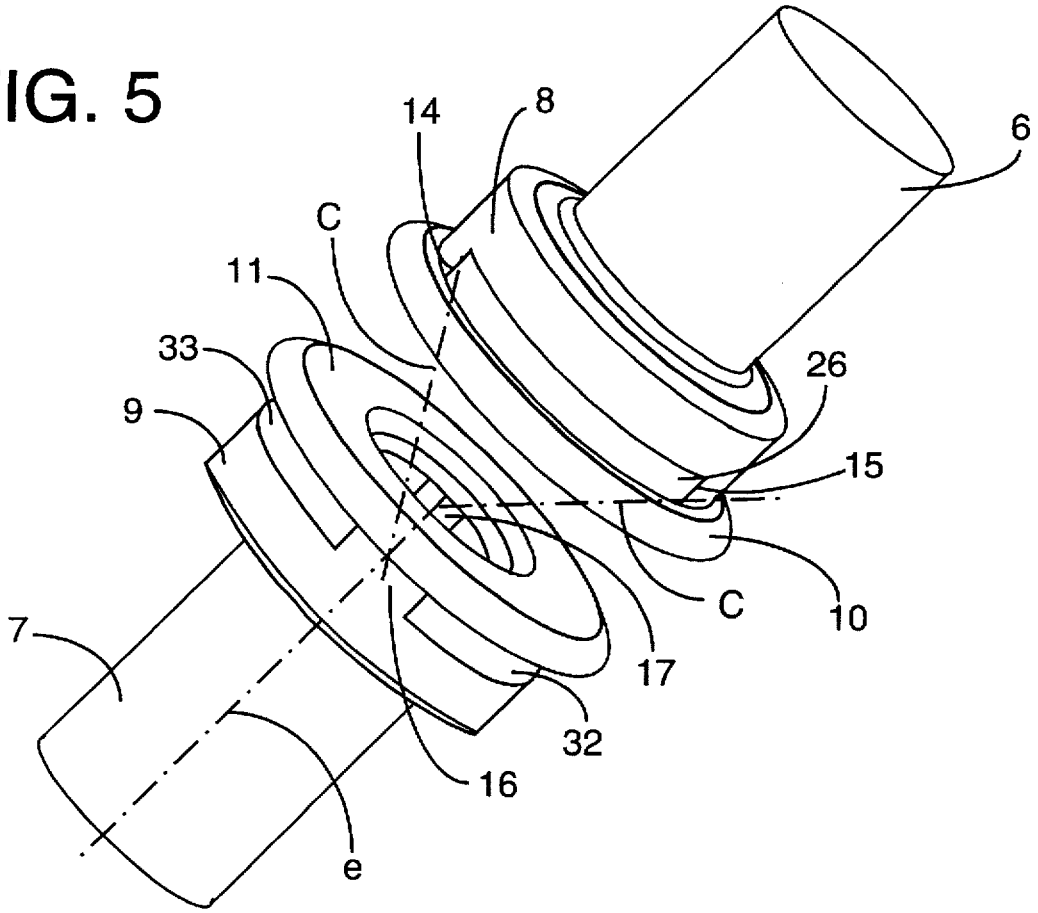
Figure 6:
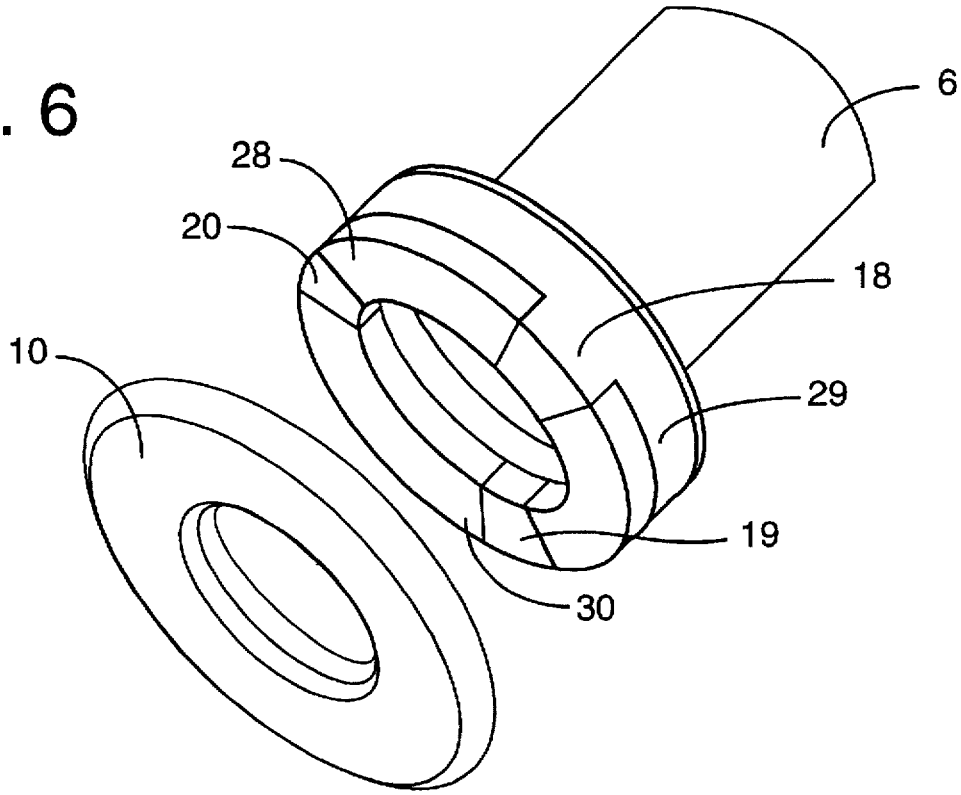
Figure 7:
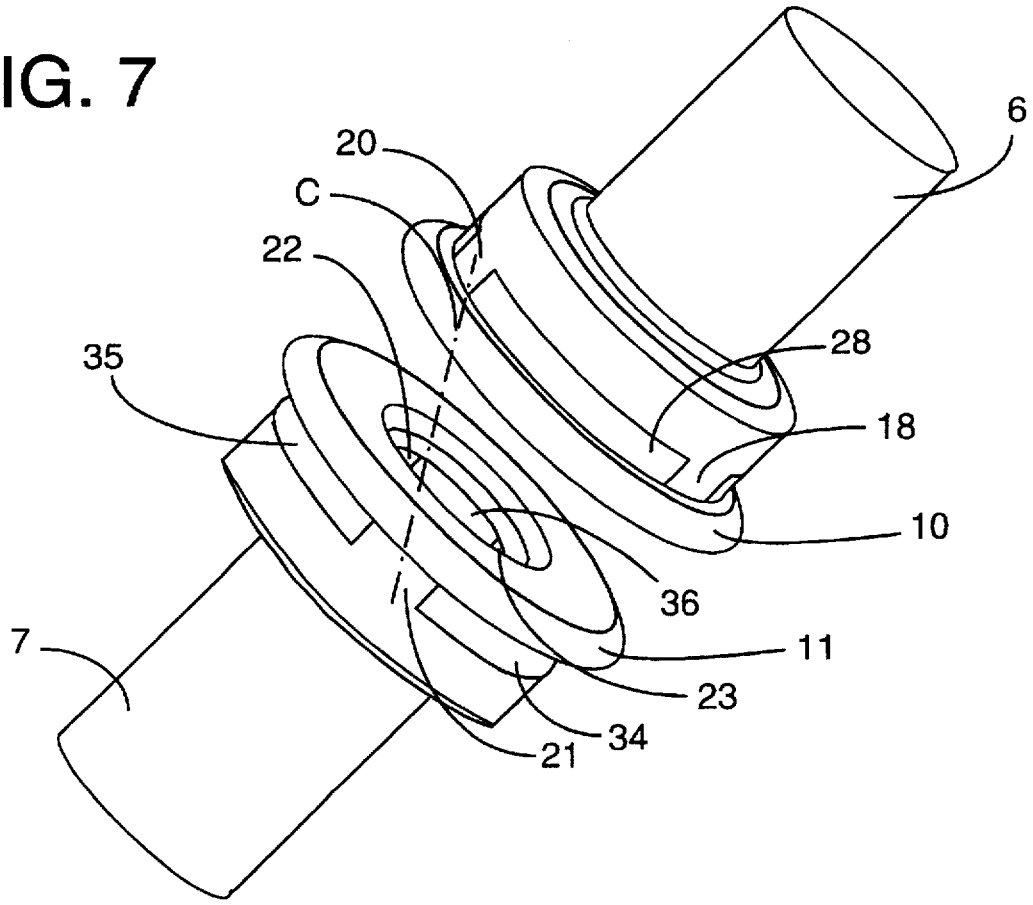

Referring to FIGS. 1–7, it can be seen that for this purpose, the end 8a, 9a of each contact part 8, 9 is shaped as a crown 37, said crown 37 being formed at the periphery of the contact parts 8, 9 and comprising conducting sectors 12–23 and non-conducting or almost non-conducting sectors 25–36. In FIG. 1, which corresponds to the embodiment illustrated in FIGS. 6 and 7, the crown 37 of each part 8, 9 is formed by three conducting sectors 18–23 and three non-conducting sectors 28, 29, 30 and 34, 35, 36. FIGS. 2 and 3 illustrate contact parts 8, 9 whose end in the shape of a crown 37 is formed by a single conducting sector 12, 13 and an insulating sector 25, 31. In this case, as can be seen in FIG. 3, the two respective conducting sectors 12, 13 of the two contact parts 8, 9 will be placed so as to be diametrically opposite. In FIGS. 4 and 5, the contact parts 8, 9 each comprise two conducting sectors 14, 15, 16, 17 and two non-conducting sectors 26, 27 and 32, 33. The two conducting sectors 14–17 of each part 8, 9 are arranged so as to be diametrically opposite and the two parts 8, 9 are arranged with respect to one another in such a way that the two diameters d, e, according to which the sectors are placed on the two parts 8, 9 are perpendicular. In FIGS. 6 and 7, the conducting sectors 18–23 and the non-conducting sectors 28, 29, 30 and 34, 35, 36 are three in number and are equidistant, the conducting sectors 18–23 of the two parts 8, 9 being arranged so as to be angularly offset.

The operation of the switch in its three embodiments will be described briefly by the following with reference to the figures.

In the closed position of the switch I, to flow from the stationary contact 4 to the movable contact 5, the current passes successively through the rod 6 of the stationary contact 4, the contact part 8, the conducting sectors, the electrode 10 of the stationary contact 4, then the electrode 11 of the movable contact 5, the conducting sectors of the movable contact 5, the contact part 9 and the rod 7 of the movable contact 5.

In the separated position of the arcing contacts 4, 5 prior to breaking, the current conveyed by the rod 6 of the stationary arcing contact 4 passes through the contact part 8 of the stationary arcing contact 4 and then reaches the conducting sectors. According to the embodiment illustrated in FIGS. 2 and 3, the arcing current "c" passes from sector 12 associated to the stationary contact 4 to sector 13 associated to the movable contact 5, passing via the electrodes 10, 11 following an inclined trajectory as represented by the dashed line in FIG. 3. The horizontal component of this current, i.e. parallel to the contact surfaces 4a, 5a of the arcing contacts 4, 5, then generates a localized axial field, enabling diffusion of the arc to be obtained by maintaining several small arcs.

When there are two or three sectors per contact part, as illustrated in FIGS. 4 to 7, several arcing currents are obtained in a direction inclined with respect to these same contact surfaces, which results in creation of an axial magnetic field.

It should be noted that the rod 6, 7, the contact part 8, 9 and the conducting sectors 12 to 23 of each arcing contact 4, 5 advantageously forming a monoblock assembly, will preferably be made of copper. The electrodes 10, 11 will advantageously be made of a chrome or copper-based conducting material, whereas the non-conducting sectors 25 to 36 will be made of an insulating or refractory material.

An electrical switch, notably a vacuum switch, has therefore been achieved by means of the invention, performing breaking in an axial field, of particularly simple design since it does not require additional means for producing an axial field and the geometry and therefore the structure of the arcing contacts remain particularly simple.

Naturally the invention is in no way limited to the embodiments described and illustrated which have been given as examples only. Thus for example it could be envisaged that the conducting sectors be achieved on the electrodes rather than on the contact parts. Likewise, the non-conducting sectors could be eliminated, especially in the case where each contact part comprises at least two conducting sectors.

On the contrary, the invention comprises all the technical equivalents of the means described and their combinations if the latter are achieved according to the spirit of the invention.

We claim:

1. An electrical circuit breaker or switch comprising an elongated vacuum cartridge, said cartridge comprising:

a cylindrical isolating enclosure having first and second end-plates;

a stationary arcing contact fixed axially inside said cartridge and to said first end-plate;

a movable arcing contact, including a rod, axially and slidingly mounted with respect to said second end-plate such that said movable contact contacts and separates from said stationary arcing contact; and means for producing an axial magnetic field in an arc formation zone between said stationary and movable arcing contacts, said means comprising means for imposing on an arcing current, generated when said movable and stationary arcing contacts are separated, an inclined trajectory with respect to a plane of contact surfaces of said movable and stationary arcing contacts, whereby a horizontal component of said inclined trajectory arcing current generates a localized axial magnetic field for diffusing an arc generated by said arcing current and whereby the arc is uniformly distributed by said axial magnetic field.

2. The switch according to claim 1, wherein said arcing contacts comprise said means for producing an axial magnetic field.

3. The switch according to claim 2, wherein each of said stationary and movable arcing contacts comprises a conducting rod comprising at one of its ends a contact part on which an electrode is fixed, the contact part and electrode being electrically connected by at least one conducting portion securedly united to the contact part or the electrode, said conducting portion of said stationary arcing contact being arranged such that said conducting portion of said movable arcing contact is offset therefrom.

4. The switch according to claim 3, wherein said contact part is in the form of a disk and said electrode is in the form of a crown or disk.

5. The switch according to claim 4, wherein said conducting portion comprises a sector of said crown, the sector associated with said stationary arcing contact being angularly offset with respect to the sector associated with said movable arcing contact.

6. The switch according to claim 3, wherein the conducting portion is an integral part of the contact part and is formed at the periphery of the contact part.

7. The switch according to claim 5, wherein each of said arcing contacts comprises a crown sector.

8. The switch according to claim 5, wherein each of said contacts comprises two diametrically opposite crown sectors.

9. The switch according to claim 5, wherein each of said arcing contacts comprises three equidistant crown sectors.

10. The switch according to claim 5, wherein the end of each contact part is in the form of a crown, said crown comprising conducting crown sectors and non-conducting crown sectors.

11. The switch according to claim 10, wherein the non-conducting crown sectors comprise insulating or refractory material.

* * * * *